US007677386B1

(12) United States Patent
Kumar

(10) Patent No.: US 7,677,386 B1
(45) Date of Patent: Mar. 16, 2010

(54) MULTI-COMPONENT SOAP SYSTEM

(76) Inventor: Sivathanu B. Kumar, 17402 Heather Oak Pl., Tampa, FL (US) 33647

( * ) Notice: Subject to any disclaimer, the term of this patent is extended or adjusted under 35 U.S.C. 154(b) by 0 days.

(21) Appl. No.: 12/290,508

(22) Filed: Oct. 31, 2008

(51) Int. Cl.
*A47K 5/08* (2006.01)

(52) U.S. Cl. ..... 206/77.1

(58) Field of Classification Search ..... 206/77.1; 211/85.12

See application file for complete search history.

(56) References Cited

U.S. PATENT DOCUMENTS

D149,066 S * 3/1948 Kaplan ..... D6/536
3,185,537 A * 5/1965 Wright ..... 312/351
4,035,122 A * 7/1977 Cavanaugh ..... 425/84
4,501,355 A * 2/1985 Hoffman ..... 206/77.1
4,831,681 A * 5/1989 Puder ..... 15/257.05
4,948,078 A * 8/1990 Dumenigo ..... 248/176.1
5,876,769 A * 3/1999 Dowden et al. ..... 425/318

* cited by examiner

*Primary Examiner*—Mickey Yu
*Assistant Examiner*—Jenine M Pagan

(57) ABSTRACT

A first uppermost tray is constructed of longitudinal and latitudinal components. Perforations are formed between the components. A fourth lowermost tray consists of a base, upstanding side and end walls and upstanding end walls. At least one intermediate tray is in a funnel like configuration. The intermediate tray has a centrally located aperture. The intermediate tray has spacer coupling posts separating the uppermost, intermediate and lowermost trays. A directing component is located above the base of the lowermost tray and beneath the aperture of the intermediate tray.

5 Claims, 6 Drawing Sheets

MULTI-COMPONENT SOAP SYSTEM

BACKGROUND OF THE INVENTION

Field of the Invention

The present invention relates to a multi-component soap dish system and more particularly pertains to the handling of moisture dripping from a bar of soap, such handling being accomplished in a sanitary, convenient, economical and eye-appealing manner.

SUMMARY OF THE INVENTION

In view of the disadvantages inherent in the known types of soap dish systems of known designs and configurations now present in the prior art, the present invention provides an improved multi-component soap dish system. As such, the general purpose of the present invention, which will be described subsequently in greater detail, is to provide a new and improved multi-component soap dish system and method which has all the advantages of the prior art and none of the disadvantages.

To attain this, the present invention essentially comprises a multi-component soap dish system. First provided is an uppermost first tray. The first tray consists of longer longitudinal components. The first tray also consists of shorter latitudinal components. The longitudinal components are linear wire like members. The longitudinal components have down turned upper support spacer coupling posts. The latitudinal components are wire like members of varying cross sectional sizes. The latitudinal components have axes. The latitudinal components have upwardly curved ends. The longitudinal and latitudinal components have perforations there between. The first tray has an exterior periphery. The wire like members are adapted to support a bar of moist soap. The wire like members are further adapted to allow moisture from the bar of soap to fall through the perforations between the wire like members.

A lower most fourth tray is provided. The fourth tray consists of a rectangular base. The base has an exterior periphery. The fourth tray has upstanding side walls. The fourth tray has upstanding end walls. The base and walls are imperforate. The base and walls form a rectilinear chamber. The fourth tray has an open top. In this manner moisture falling from a moist bar of soap on the first tray is received. The end and side walls have upwardly extending lower support spacer coupling posts. The lower support spacer coupling posts are provided at upper corners of the fourth tray.

Provided next is an upper intermediate second tray. Also provided is a lower intermediate third tray. The second and third trays are each in a funnel like configuration. The second and third trays have four trapezoidal sections. The second and third trays each have an exterior periphery. The second and third trays each have a centrally located aperture. In this manner moisture from the first tray is directed to the fourth tray. The second tray is provided below and in proximity to the first tray. The third tray is provided above and in proximity to the fourth tray. The second and third trays each have intermediate support spacer coupling posts. The intermediate support spacer coupling posts extending upwardly from the lower intermediate tray adjacent to corners thereof.

A directing component is provided next. The directing component has a conical upper face. The directing component has a conical lower face. A support rod is provided. The support rod extends upwardly from the base of the fourth tray.

The support rod is sized and located to position the directing component a short distance beneath the aperture of the third tray.

Further provided is a drain hole. The drain hole is provided in one of the walls of the fourth tray adjacent to the base. In this manner the removal of moisture from the fourth tray is facilitated. A removable plug is provided. The removable plug selectively fills the drain hole. A drain tube is provided. The drain tube conveys moisture from the fourth tray to exterior of the system.

Provided last is a passageway. The passageway is provided beneath the base of the fourth tray for the passage of heated water to heat the system and moisture therein. The passageway includes a heating tube. The heating tube provides for the passage of heated water.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multi-component soap dish system which has all of the advantages of the prior art soap dish systems of known designs and configurations and none of the disadvantages.

It is another object of the present invention to provide a new and improved multi-component soap dish system which may be easily and efficiently manufactured and marketed.

It is further object of the present invention to provide a new and improved multi-component soap dish system which is of durable and reliable constructions.

An even further object of the present invention is to provide a new and improved multi-component soap dish system which is susceptible of a low cost of manufacture with regard to both materials and labor, and which accordingly is then susceptible of low prices of sale to the consuming public, thereby making such multi-component soap dish system economically available to the buying public.

Even still another object of the present invention is to provide a multi-component soap dish system for the handling of moisture dripping from a bar of soap, such handling being accomplished in a sanitary, convenient, economical and eye-appealing manner.

Lastly, it is an object of the present invention to provide a new and improved multi-component soap dish system. A first uppermost tray is constructed of longitudinal and latitudinal components. Perforations are formed between the components. A fourth lowermost tray consists of a base, upstanding side and end walls and upstanding end walls. At least one intermediate tray is in a funnel like configuration. The intermediate tray has a centrally located aperture. The intermediate tray has spacer coupling posts separating the uppermost, intermediate and lowermost trays. A directing component is located above the base of the lowermost tray and beneath the aperture of the intermediate tray.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
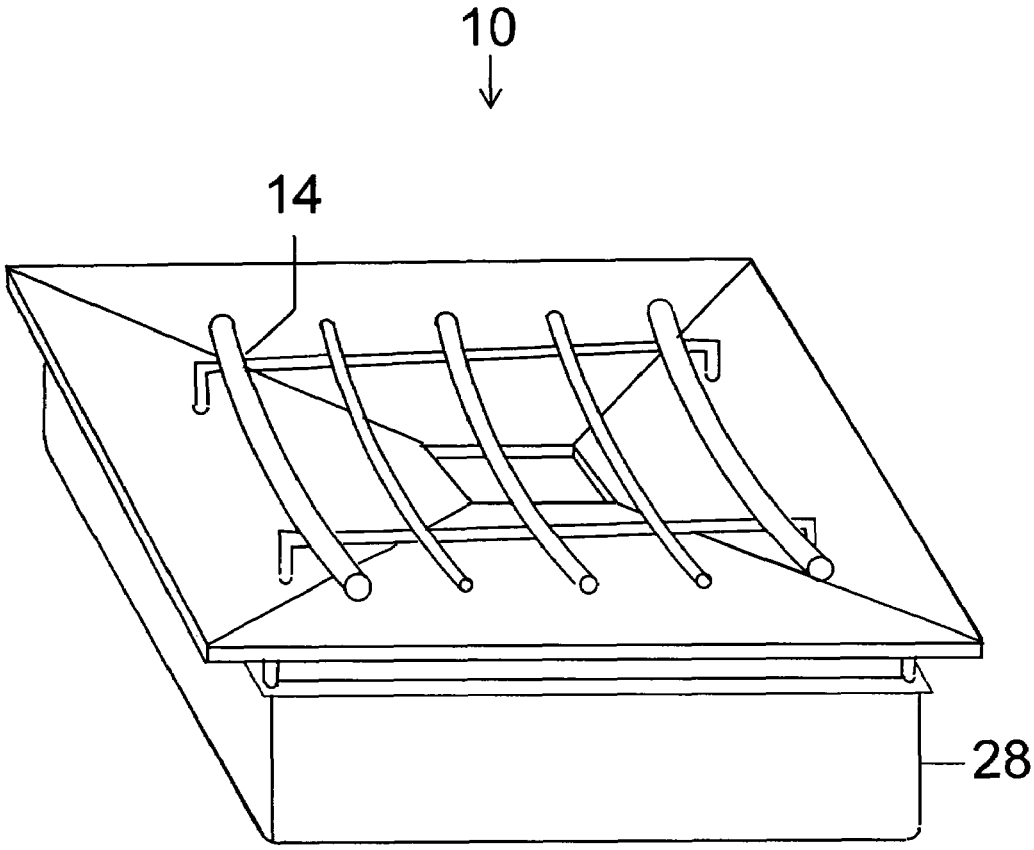
FIG. 1 is a perspective illustration of a multi-component soap dish constructed in accordance with the principles of the present invention.
Figure 2:
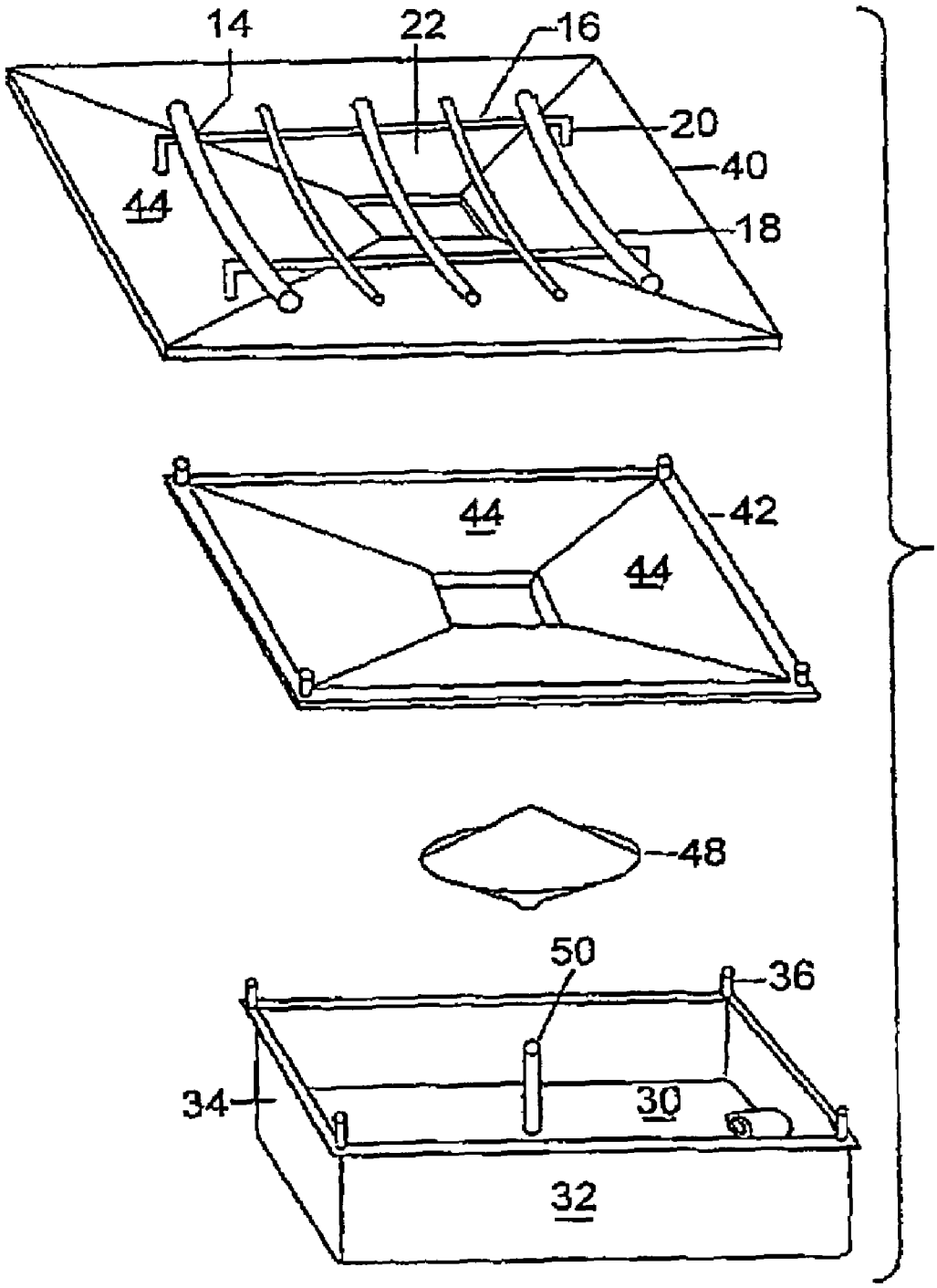
FIG. 2 is an exploded perspective illustration of the system shown in FIG. 2.

With reference now to the drawings, and in particular to FIG. 1 thereof, the preferred embodiment of the new and improved multi-component soap dish system embodying the principles and concepts of the present invention and generally designated by the reference numeral 10 will be described.

The present invention, the multi-component soap dish system 10 is comprised of a plurality of components. Such components in their broadest context include a first component, a fourth lowermost tray, at least one intermediate tray and a directing component. Such components are individually configured and correlated with respect to each other so as to attain the desired objective.

First provided is an uppermost first tray 14. The first tray consists of longer longitudinal components 16. The first tray also consists of shorter latitudinal components 18. The longitudinal components are linear wire like members. The longitudinal components have down turned upper support spacer coupling posts 20. The latitudinal components are wire like members of varying cross sectional sizes. The latitudinal components have axes. The latitudinal components have upwardly curved ends. The longitudinal and latitudinal components have perforations 22 there between. The first tray has an exterior periphery. The wire like members are adapted to support a bar of moist soap 24. The wire like members are further adapted to allow moisture from the bar of soap to fall through the perforations between the wire like members.

A lower most fourth tray 28 is provided. The fourth tray consists of a rectangular base 30. The base has an exterior periphery. The fourth tray has upstanding side walls 32. The fourth tray has upstanding end walls 34. The base and walls are imperforate. The base and walls form a rectilinear chamber. The fourth tray has an open top. In this manner moisture falling from a moist bar of soap on the first tray is received. The end and side walls have upwardly extending lower support spacer coupling posts 36. The lower support spacer coupling posts are provided at upper corners of the fourth tray.

Provided next is an upper intermediate second tray 40. Also provided is a lower intermediate third tray 42. The second and third trays are each in a funnel like configuration. The second and third trays have four trapezoidal sections 44. The second and third trays each have an exterior periphery. The second and third trays each have a centrally located aperture. In this manner moisture from the first tray is directed to the fourth tray. The second tray is provided below and in proximity to the first tray. The third tray is provided above and in proximity to the fourth tray. The second and third trays each have intermediate support spacer coupling posts. The intermediate support spacer coupling posts extending upwardly from the lower intermediate tray adjacent to corners thereof.

A directing component 48 is provided next. The directing component has a conical upper face. The directing component has a conical lower face. A support rod 50 is provided. The support rod extends upwardly from the base of the fourth tray. The support rod is sized and located to position the directing component a short distance beneath the aperture of the third tray.

Figure 3:
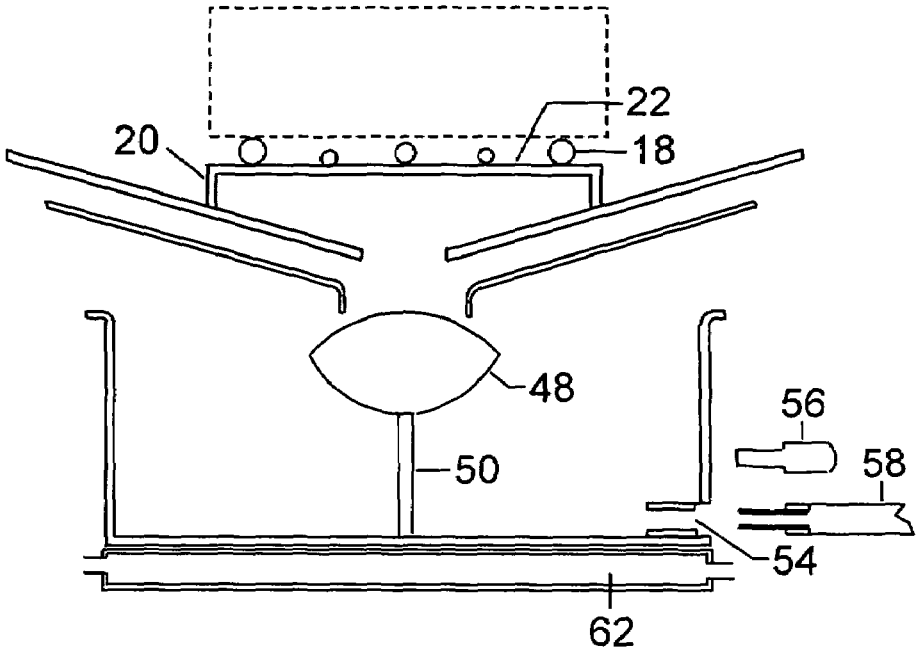
FIGS. 3, 3A and 3B are cross sectional views of alternate embodiments of the invention.
Figure 3A:
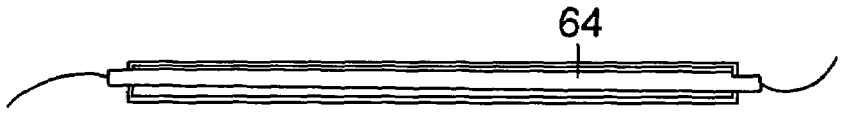
Figure 3B:
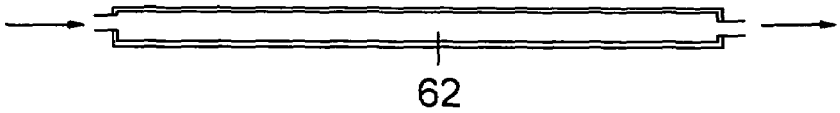

Optional features of the invention are illustrated in FIGS. 3, 3A and 3B. In such Figures, further provided is a drain hole 54. The drain hole is provided in one of the walls of the fourth tray adjacent to the base. In this manner the removal of moisture from the fourth tray is facilitated. A removable plug 56 is provided. The removable plug selectively fills the drain hole. A drain tube 58 is provided. The drain tube conveys moisture from the fourth tray to exterior of the system.

Provided last is a passageway 62. The passageway is provided beneath the base of the fourth tray for the passage of heated water to heat the system and moisture therein. The passageway includes a heating tube 64 or tubes. The heating tube provides for the passage of heated water.

Figure 4:
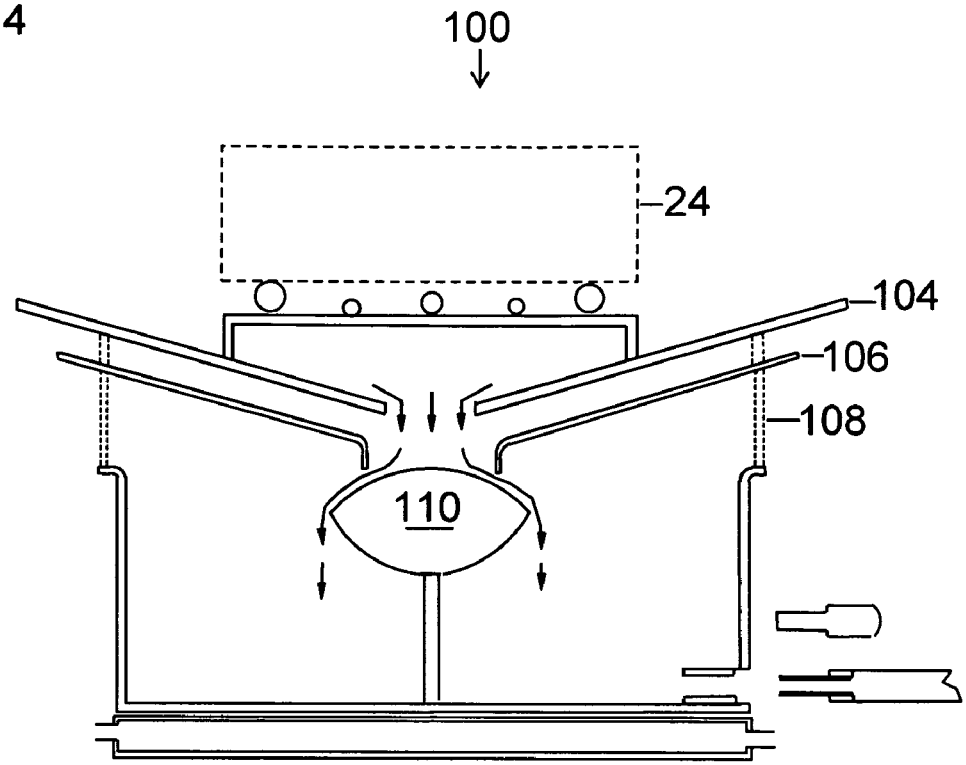
FIGS. 4 and 4A are cross sectional views of the primary embodiment of the system illustrating moisture falling into and being removed from the lowermost tray.
Figure 4A:
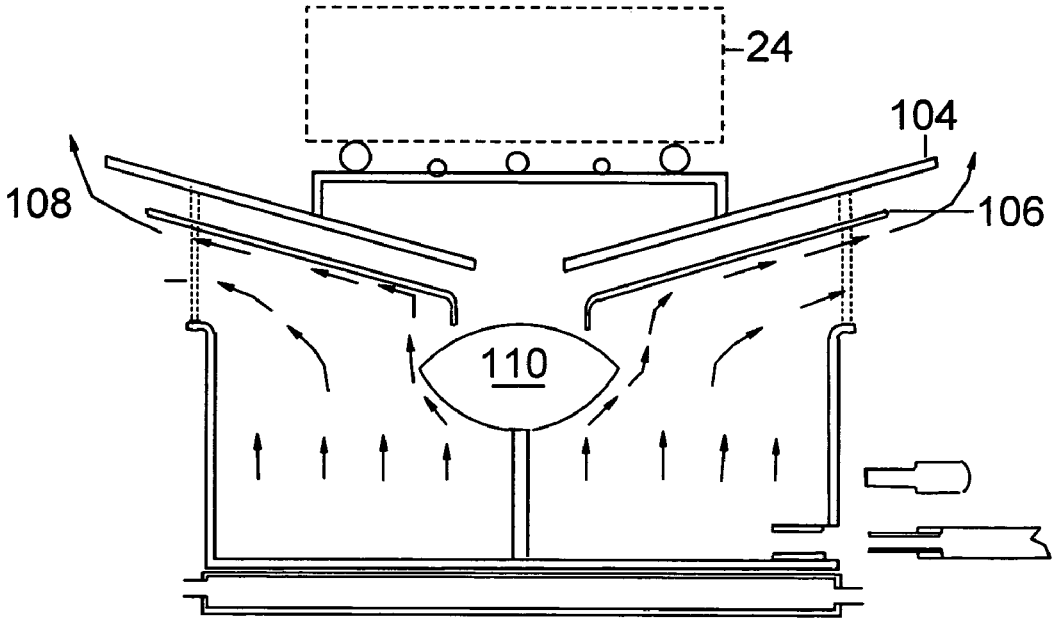

FIG. 4 includes arrows illustrating the path moisture travels from a moist bar of soap 24 to the fourth tray. FIG. 4A includes arrows illustrating the path moisture travels from the fourth tray to exterior of the tray by evaporation and/or tipping. The system 100 includes components as in the prior embodiment. Such components include second and third trays 104, 106 as well as support spacer coupling posts 108 with a directing component 110.

Figure 5:
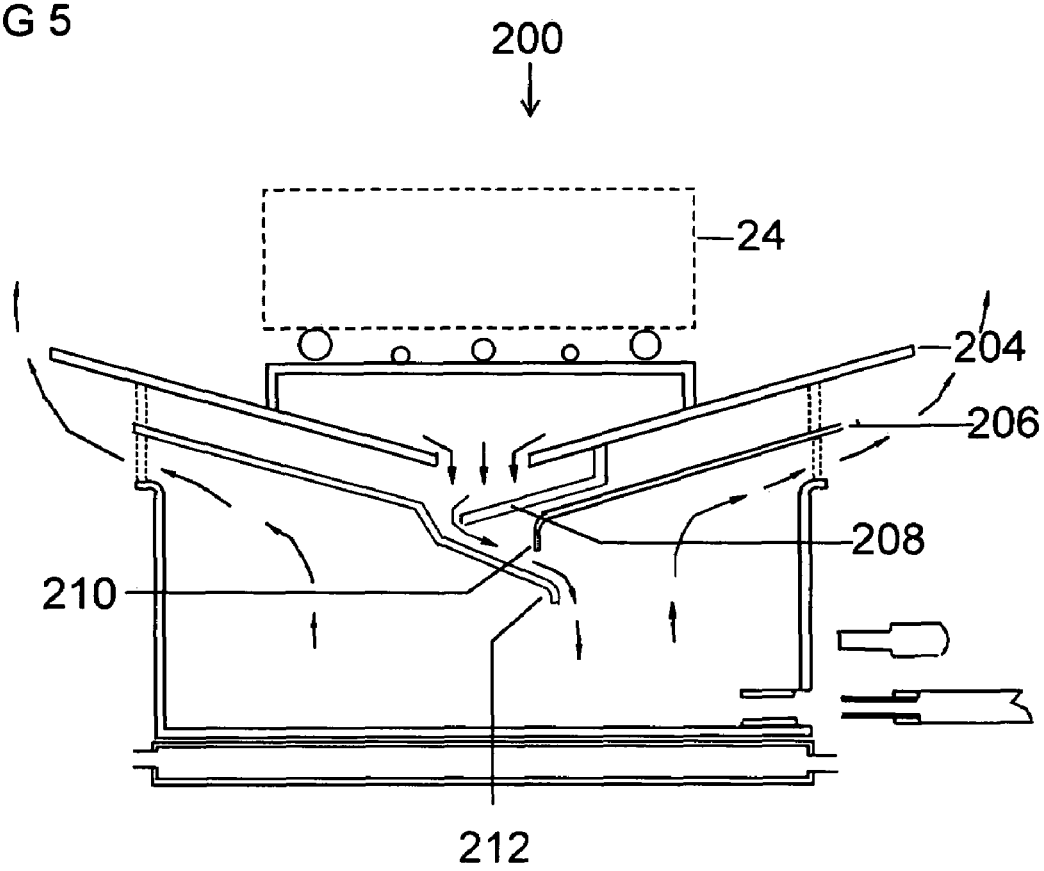
FIGS. 5 and 6 are cross sectional views of additional alternate embodiments of the invention

FIG. 5 illustrates a system 200 constructed in accordance with an alternate embodiment of the invention. In such alternate embodiment, the second and third trays 204, 206 are as in either of the prior embodiments. The reflector and its spacer coupling post are eliminated. A supplemental moisture deflector 208 depend from the second tray at one edge of the hole to a location below the hole of the second tray. The edge 210 of the third tray beneath the supplemental moisture deflector depends downwardly and restricts the size of the moisture passageway and directs the moisture to the periphery. Lastly, the lower edge 212 of the third tray opposite from the supplemental moisture deflector is extended in a plane beneath an adjacent tray section to place it as a deflector above the base of the fourth tray and beneath the holes of the intermediate trays.

Figure 6:
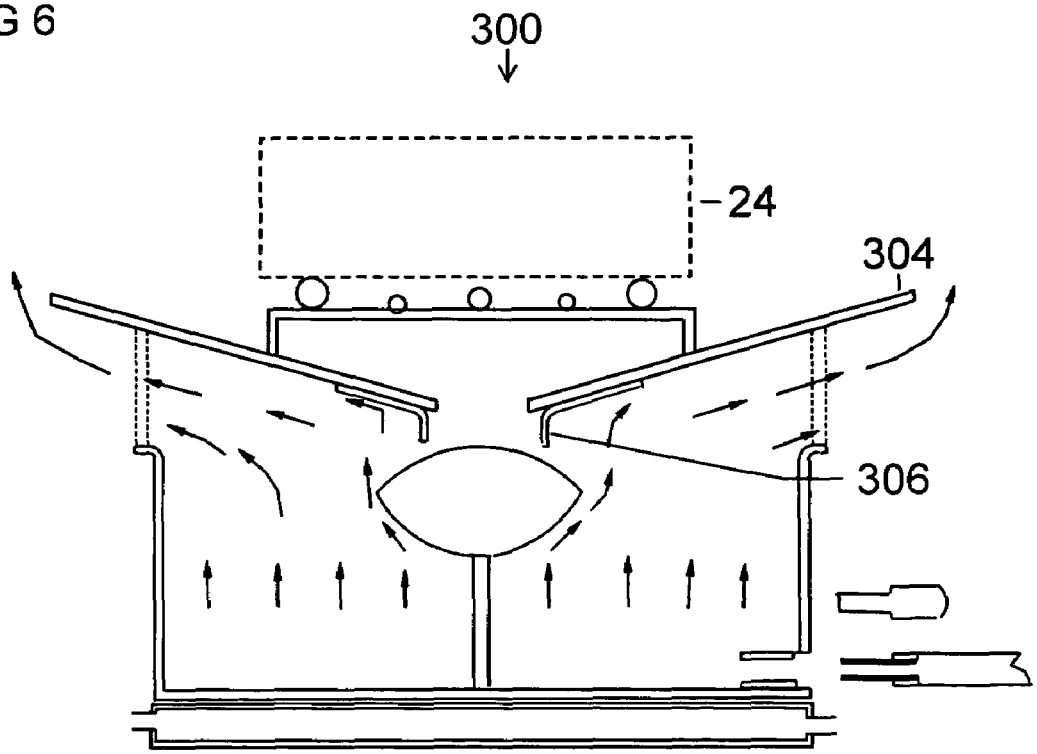

The final alternate embodiment of the invention is a system 300 illustrated in FIG. 6. In such embodiment, the two intermediate trays, the second and third trays, are replaced by a single intermediate tray 304. The edges of the section of the intermediate tray are planar with generally L-shaped guides 306 secured to the four edges of the intermediate tray adjacent to the hole.

Figure 7:
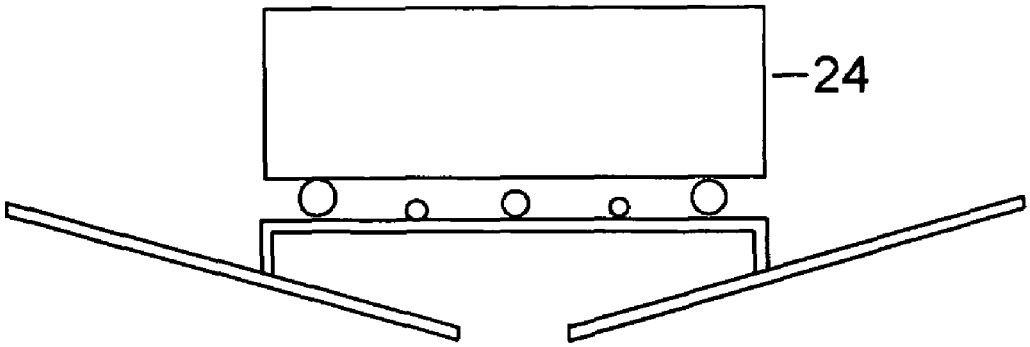
FIGS. 7, 7A and 7B are cross sectional views of the two upper trays and bars of soap in various positions.
Figure 7A:
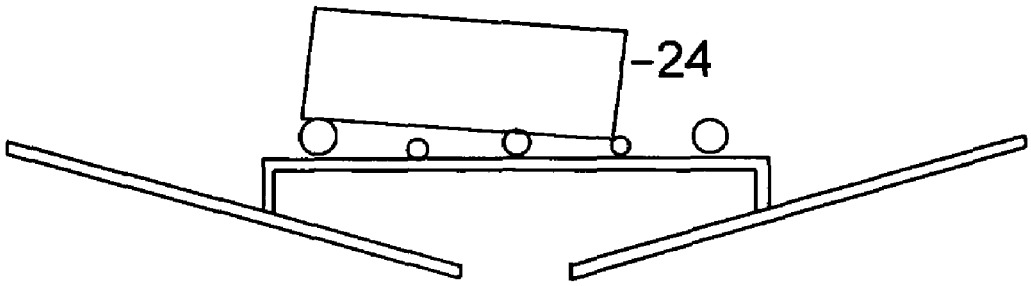
Figure 7B:
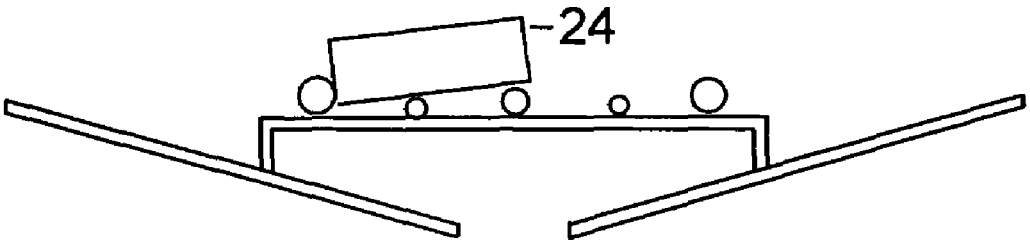

The position of bars of soap 24 of various sizes may be seen in FIGS. 7, 7A and 7B. Regardless of the size or position of a bar of soap on the first tray, the flow of moisture into the fourth tray will be the same.

The present invention is a soap dish system consisting of a perforate first tray with an open top, perforate and partly open upstanding sides and a perforate bottom.

Second and third trays are provided. The upper surfaces are concave and the bottom surface are convex. These trays have aperture at the lowest point of concavity of the upper surfaces for the passage of moisture. The aperture at the lower surface of the third tray has a vertically oriented ring attached along the periphery.

A fourth imperforate tray is placed bellow the second and third trays. This tray has an imperforate bottom, upstanding sides and an open top. The moisture drained from the first tray through the aperture of the second and third trays are collected in the fourth tray.

An imperforate directing component is next provided. It is formed with concave top and bottom surfaces. It is positioned below the aperture of the second and third trays. An upstanding projection of the fourth tray places this component at this position. The upper concave surface of this component directs the moisture from the first tray to fall into the fourth tray while directing the moisture from the evaporated moisture vapor from the fourth tray in a direction away from the aperture and the soap. The concave bottom surface of the third tray further directs the moisture to the lateral openings hence the soap placed on the first tray. The moisture contained in the fourth tray may be emptied by manipulation of an operator by tilting the tray.

The top surface of the ridges of the first, uppermost tray are at varying heights. This enables the unused larger soap bars to have fewer contact points and prevents used smaller bars of soap from falling through. Note FIGS. 7, 7A and 7B.

The fourth tray has a drain hole for the connection of a drain tube. The drain tube drains the moisture contained in the tray and disposes the moisture eliminating the need for an operator to empty the tray periodically. The tray has an opening for the drain tube to be connected to by an operator or the opening is closed by inserting a stopper by the operator.

Also provided are components to heat the tray. The heating element placed under the fourth tray is heated by circulating hot water through the heating element or by using any other heating electrical source. This hastens the evaporation and elimination of the moisture contained in the fourth tray.

It is within the scope of this invention not to include all the components and features described in an embodiment while still keeping the spirit of this invention.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multi-component soap dish system comprising:

a first uppermost tray constructed of longitudinal and latitudinal components forming openings there between;

a second upper intermediate tray below and in proximity to the first tray and being in a funnel like configuration formed of four trapezoidal sections and having an exterior periphery and a central aperture;

a third lower intermediate tray below and in proximity to the second tray and being in a funnel like configuration formed of four trapezoidal sections and having an exterior periphery and a central aperture;

a fourth lowermost tray consisting of a rectangular base, upstanding side walls and upstanding end walls;

spacer coupling posts separating the trays; and a directing component located above the base of the fourth lowermost tray and beneath the central aperture of the third lower intermediate tray.

2. The system as set forth in claim 1 wherein the second upper intermediate tray has the greatest exterior periphery and the first uppermost, third lower intermediate, and fourth lowermost trays have smaller exterior peripheries.

3. The system as set forth in claim 1 and further including a supplemental moisture deflector depending from one edge of the central aperture of the second upper intermediate tray to a location below the central aperture of the second upper intermediate tray, and further including a supplemental moisture deflector depending from one edge of the central aperture of the third lower intermediate tray to a location adjacent to the fourth lowermost tray and placed in a different horizontal plane, and wherein;

the edge of the third lower intermediate tray beneath the supplemental moisture deflector depends downwardly and restricts the passage of moisture and directs the moisture to a periphery, the lower edge of the third lower intermediate tray opposite from the supplemental moisture deflector is extended in a plane beneath an adjacent tray section to place it as a deflector above the base of the fourth lowermost tray and beneath the intermediate trays.

4. A multi-component soap dish system for the handling of moisture dripping from a bar of soap, such handling being accomplished in a sanitary, convenient, economical and eye-appealing manner, the system comprising, in combination:

an uppermost first tray, the first tray consisting of longer longitudinal components and shorter latitudinal components, the longitudinal components being linear wire like members with down turned upper support spacer coupling posts, the latitudinal components being wire like members of varying cross sectional sizes with axes having curved ends, the longitudinal and latitudinal components forming openings there between, the first tray having an exterior periphery with the wire like members adapted to support a bar of moist soap and allow moisture from the bar of soap to fall through the openings between the wire like members;

a lower most fourth tray, the fourth tray consisting of a base with an exterior periphery and upstanding side walls and upstanding end walls, the base and walls being imperforate and forming a chamber with an open top for receiving moisture falling from a moist bar of soap on the first tray, the end and side walls having upwardly extending lower support spacer coupling posts at upper corners of the fourth tray;

an upper intermediate second tray and a lower intermediate third tray, the second and third trays each being in a funnel like configuration and formed of four trapezoidal sections, the second and third trays each having an exterior periphery and a centrally located aperture for directing moisture from the first tray to the fourth tray, the second tray being below and in, proximity to the first tray, the third tray being above and in proximity to the fourth tray, intermediate support spacer coupling posts extending upwardly from the lower intermediate tray adjacent to corners thereof;

a directing component having a conical upper face and a conical lower face, a support rod extending upwardly from the base of the fourth tray sized and located to position the directing component a short distance beneath the aperture of the third tray;

a drain hole in one of the walls of the fourth tray adjacent to the base for facilitating the removal of moisture from the fourth tray, a removable plug for selectively filling the drain hole, a drain tube for conveying moisture from the fourth tray to exterior of the system; and a passageway beneath the base of the fourth tray for the passage of a heating means to heat the system and moisture therein.

5. A moisture handling system having a plurality of vertically spaced concave trays including an upper tray with openings, a lower tray with side walls, and at least one intermediate tray, and having spaces between the lower tray and at least one intermediate tray and lateral openings, each intermediate tray having a central aperture, a directing component supported by the lower tray beneath the central apertures of the intermediate trays, a wet member such as but not limited to a bar of soap supported on the upper tray;

the shape, size and angles of the directing component and the trays adapted to channel a flow of moisture vapor originating from liquid moisture which is drained from the wet in a direction which is away from the apertures and the evaporated moisture vapor is further directed towards lateral openings and removed through the lateral openings and thus evaporated moisture is prevented from reaching the bar of soap again;

means for directing a flow of evaporated moisture vapor originating from liquid moisture which is drained from the bar of soap and into the lower tray in a path between the trays and is directed away in part by the directing component and away from the apertures and away from the bar of soap and thus not allowing the evaporated moisture vapor to reach the bar of soap and the upper tray;

the direction of the flow of evaporated moisture vapor being guided by and formed in part by the spaces between the trays and the shape and angles of the trays and directing component, the spaces between the trays thus forming in part the lateral openings and a moisture vapor directing passage way for directing the flow of evaporated moisture vapor of the drained moisture, the evaporated moisture vapor being directed towards the lateral openings and removed through the lateral openings and thus away from the soap;

the intermediate trays and the directing component further directing and allowing the passage of moisture from, such as but not limited to, the moisture of soap when wet to be drained into the lower tray but not allowing the evaporated moisture vapor from reentering the apertures and thus preventing the evaporated moisture vapor contacting the upper tray and the bar of soap.

* * * * *

UNITED STATES PATENT AND TRADEMARK OFFICE

CERTIFICATE OF CORRECTION

PATENT NO. : 7,677,386 B1
APPLICATION NO. : 12/290508
DATED : March 16, 2010
INVENTOR(S) : Sivathanu B. Kumar It is certified that error appears in the above-identified patent and that said Letters Patent is hereby corrected as shown below:

Page 1 (54) and Column 1, Line 1

Title of the Invention is corrected to "Multi-Component Soap Dish System"

Signed and Sealed this
Fifth Day of July, 2011

David J. Kappos

David J. Kappos
*Director of the United States Patent and Trademark Office*